US005772044A

United States Patent [19]

Euzen et al.

[11] Patent Number: 5,772,044

[45] Date of Patent: Jun. 30, 1998

[54] APPARATUS FOR CONCENTRATING FINE OR BROKEN PARTICLES

[75] Inventors: Jean-Paul Euzen, Dardilly; Jean De Bonneville, Rueil Malmaison; Daniel Vuillemot, Saint Genis Laval, all of France

[73] Assignee: Institut Francais Du Petrole, Rueil Malmaison, France

[21] Appl. No.: 508,459

[22] Filed: Jul. 28, 1995

[30] Foreign Application Priority Data

Jul. 29, 1994 [FR] France ..... 94 09558

[51] Int. Cl.[6] ..... B07B 1/00

[52] U.S. Cl. ..... 209/236; 209/240; 209/355

[58] Field of Search ..... 209/235, 236, 209/240, 242, 246, 254, 355

[56] References Cited

U.S. PATENT DOCUMENTS 4,231,861 11/1980 Hannie et al. ..... 209/240
4,738,774 4/1988 Patrick ..... 209/240 X
5,123,542 6/1992 Hoppe ..... 209/236

FOREIGN PATENT DOCUMENTS 482 683 4/1992 European Pat. Off. .
1335326 9/1987 U.S.S.R. ..... 209/240

*Primary Examiner*—Tuan Nguyen
*Attorney, Agent, or Firm*—Millen, White, Zelano, & Branigan, P.C.

[57] ABSTRACT

An apparatus is provided for concentrating fine or broken particles to separate a particle stream into at least one stream which is concentrated in fine or broken particles and at least one stream with a reduced concentration of fine or broken particles. In addition to introduction and extraction structure, the apparatus includes at least two separator stages each comprising at least one funnel with an inclined or substantially vertical axis which opens upwardly, located beneath an inlet to collect the particles. The funnel is connected to at least one deflector which is directed downwardly to allow particles to flow under gravity and to form a bank of particles at the level of the funnel.

16 Claims, 1 Drawing Sheet

APPARATUS FOR CONCENTRATING FINE OR BROKEN PARTICLES

FIELD OF THE INVENTION

The present invention concerns an apparatus for concentrating fine or broken particles, particularly for use in installations containing mobile bed catalytic reactors, in particular catalytic reforming installations.

BACKGROUND OF THE INVENTION

The presence of fine or broken particles is a nuisance in all reactors, particularly mobile bed reactors since they cause a number of problems.

Firstly, these particles alter the porosity of the medium which disturbs the regularity of the gas flow and thus directly affects the performance of the unit.

Secondly, the presence of fine particles alters the flow conditions of the solid particles in the mobile bed itself, particularly in the case of annular beds (delimited by concentric screens) in contact with the screen of the central collector, since the fine or broken particles are entrained by the fluids and forced towards the screen of the central collector where they can block. In this case, the frictional characteristics of the screen are considerably degraded, slowing down the movement of the particles in this zone, causing varying sizes of groups of particles to block against the screen, or even blocking the whole mobile bed, which is particularly deleterious to the operation and performance of the mobile bed reactor and in fact the whole unit.

SUMMARY OF THE INVENTION

In order to overcome these problems, the present invention provides a concentrating apparatus for separating a particle stream having a concentration $C_0$ of fine or broken particles (depending on requirements, fine particles are defined as those in which the average diameter is lower than a certain limit, either in absolute terms or relative to the average diameter of the particles) into at least two streams. At least one of the streams obtained (termed the stream with a reduced concentration of fine or broken particles) has a concentration $C_1$ of fine particles which is substantially lower than $C_0$, while the other stream(s) (termed the stream which is concentrated in fine or broken particles) has a concentration $C_2$ which is substantially higher than the concentration $C_0$ in the initial stream.

We have sought to accomplish this aim by developing an apparatus which does not contain a rotating portion nor involves high velocity particles (such as in a cyclone), which does not break up the particles (as can happen in some sieves) and which is as simple as possible and as compact as possible so that it can be integrated into existing industrial installations.

More precisely, the invention concerns an apparatus for concentrating fine or broken particles under gravitational flow, comprising:

at least one means for introducing, under gravity, a stream of particles to be treated containing a concentration $C_0$ of fine or broken particles, at least two separator stages each comprising at least one funnel with an inclined or substantially vertical axis which opens upwardly, located below said introduction means to collect said particles, said stage also comprising at least one deflector connected to said funnel and directed downwardly to allow gravitational flow of the particles and to create a bank of particles at the level of the funnel, at least one means for extracting a particle stream with a concentration $C_1>C_0$ of fine or broken particles termed the concentrated stream, said means being located substantially on the axis of the final funnel, at least one means for recovering at least one stream of particles with a concentration $C_1<C_0$ of fine or broken particles.

BRIEF DESCRIPTION OF THE DRAWINGS

The apparatus and its operation will be better understood from FIGS. 1 and 2.

DETAILED DESCRIPTION

Figure 1:
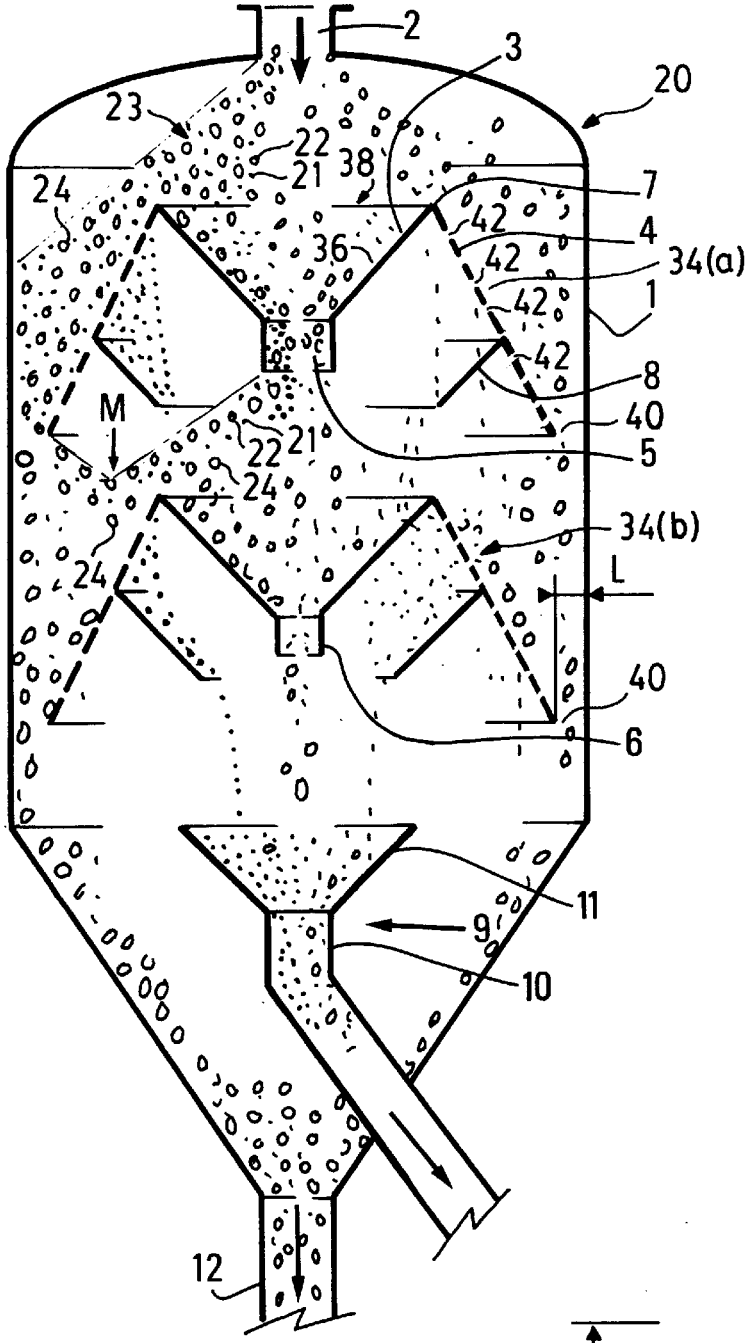
FIG. 1 shows an embodiment containing several separating stages.

The apparatus of the invention as shown in FIG. 1 is located in a cylindrical container 1 with a conical base (which could also be hemispherical or elliptical) and an external wall.

An introduction means 2 supplies the stream of particles to be treated to the first stage separator under gravity.

Most of this stream is constituted by quasi-spherical particles, i.e., particles which can roll, of varying sizes. By way of non-limiting example, these particles may be reforming catalyst particles with a diameter of 1.5 to 2.8 mm.

The particle stream flows through the apparatus under gravity.

In FIG. 1, the first separator stage comprises a funnel 3 and a deflector 4 connected to the funnel.

Figure 2:
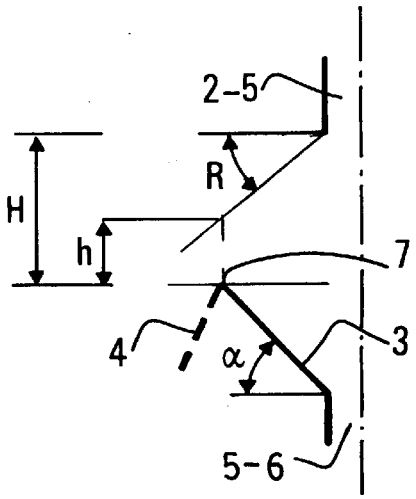
FIG. 2 shows a detail of a separating stage.

All the separator stages have this structure which is shown in FIG. 2.

FIG. 1 thus comprises two separator stages in series. The particle introduction means for the second separator is orifice 5 of the first separator which preferably comprises a collar.

The number of separator stages can readily be increased to further improve the separation of the fine or broken particles, depending on requirements.

Funnel 3, deflector 4 and the introduction means are substantially on the same axis, which is vertical or inclined to allow gravitational flow, preferably substantially vertical.

The funnel collects a portion of the particles from the upper introduction means before redistributing them via a reduced size orifice located substantially vertically below the first introduction point. The funnel opens upwardly. The upper diameter is preferably a fraction approximately between ¼ and ⅓ of the diameter of the receptacle and the upper portion is located so as to intercept a large fraction, between ⅓ and ¾, of the bank of solid particles while leaving a free annular space to allow the flow of the remainder of the particles.

The outer edge 7 of the funnel must be located at a distance H from the lower extremity of the particle introduction means (collar 2 or 5). This distance is of the order of several centimeters.

The top of the bank may or may not be clear, depending on the size of this distance.

A distance h can also be defined between the outer edge 7 of the funnel and a line passing from the corresponding edge of the particle supply collar at an angle equal to the angle R of the bank to the horizontal (FIG. 2) or rest angle.

The bank angle and the angle of friction for the particles can be determined from known tests, some of which are standardized.

The cross sectional area of orifice 5 at the exit to the funnel (located on the axis of the funnel) is preferably close to the cross sectional area of the particle introduction means, and can be lower.

The inclination angle a of the funnel (or that of its flat faces) to the horizontal is greater than the sliding angle of the particles on the surface of the deflector to allow regular flow of particles which fall against this edge of the funnel. It is generally higher than the sliding angle by at least 5 to 10 degrees. The truncated conical or prismatic base forming the funnel can also be prolonged by a short collar 6.

The deflector is intended to direct the largest and roundest particles towards the wall and edge. It is truncated or prismatic in form and opens downwardly. In its upper portion, its diameter is the same as the diameter of the upper portion of the funnel such that the line of intersection formed is circular if the funnel and deflector are true conical sections (conical in form), but a broken line is formed if the funnel and/or the deflector are prismatic in form. The deflector and funnel are thus connected. The lower portion of the deflector leaves a space L for the passage of particles which is sufficient to avoid arching effects or blockages against the outer wall of container 1, i.e., a space of at least 10 times the diameter of the largest particles, preferably at least 20 times, but not so small that the bank, which falls in towards the centre from the edge of the deflector, cannot reach the outer edge of the funnel immediately below. The inclination of the deflector to the horizontal is more than the sliding angle of the particles on the deflector surface by at least about 5 to 10 degrees to produce a regular flow of particles which fall against the deflector.

Depending on the quality of separation desired, the user can define angle a, length L (the distance between the lower extremity of the deflector and the wall) and h (the vertical distance between the upper edge of the funnel and the upper surface of the bank) or H (the vertical distance between the upper edge of the funnel and the introduction means).

When a bank forms naturally beneath a supply orifice for introducing particles with quite a large granulometric distribution of diameters, or which contain both substantially round particles and others with more angular shapes, frequently as a result of breakage of the round particles, these particles do not all have the same probability of passing to a particular region of the bank. In fact, the largest round particles roll far more easily down the bank and only stop at the edge, while the finest particles have a lower kinetic energy and thus stop faster and more easily, and also often find a hollow, i.e., a small space between immobile particles, in which they stick and stop. In the same way, particles with flatter angles or faces are more likely to stop on the bank of the bank without reaching the edge. As a consequence, the average diameter of the particles increases regularly from the axis of the bank, at a point vertically below the supply point up to the edge, in the lower part of the bank.

The apparatus thus uses this principle and regularly brings a portion of the bank formed directly below the supply orifices towards the centre. This procedure can be repeated once or more by superposing a number of separator stages which each separate a stream of particles into two, namely a stream of particles which is enriched in fine or broken particles which are re-centred while a second stream which is less rich in fine or broken particles is forced outwards.

Care must be taken that the funnel immediately below (associated with a deflector) is positioned so that the intersection (M in FIG. 1) between the bank created at the level of this funnel and the free particles flowing from the upper deflector is located outside the upper cross section of the funnel.

The deflector surface can be truncated or prismatic, and its surface can be smooth or in the form of a screen or plate provided with slots or perforations to allow the finest particles to pass through while allowing particles of average or large size to slide towards the edge. If, as is shown in FIG. 1, this wall is not solid, then advantageously a small solid frustoconical plate 8 is placed below the screen or perforated plate to collect and re-centre the fine particles which pass through the screen. Clearly, this truncated plate or re-centering collar 8 must not in any way obstruct the flow from the bank which falls through the preceding orifice 5. As can be seen, this plate is directed towards the lower portion of the apparatus and towards the axis of the associated funnel.

Each of the extraction streams can, of course, by regulated independently using a suitable means such as a mechanical or pneumatic valve. Advantageously, the distances L and diameters of collars 12 and 10 can be set so that the particles can flow freely without being sorted. In this case, discontinuous sorting would be carried out.

At the bottom of the apparatus, the stream which is concentrated in fine or broken particles is extracted by means 9 located substantially coaxially with the final funnel, i.e., the funnel immediately above the extraction means.

As shown in FIG. 1, this means 9 comprises a tube 10 which is advantageously connected to a funnel 11 collecting the concentrated stream in a zone around the axis of the final funnel. Any other means for collecting and evacuating the concentrated stream would also be suitable.

The stream of remaining particles containing all the other particles which are not evacuated by means 9 is advantageously recovered, as shown in FIG. 1, from the bottom of container 1 which is preferably conical or elliptical, and evacuated by means 12.

Any other recovery means for the stream would be suitable, in particular the means normally found at the bottom of mobile bed reactors or silos.

In a variation, the funnels and deflectors are channelled, in particular if they are composed of flat planes, and thus have a connection line which is not planar to allow a greater variation in the flow rates of the solids without compromising the operating principle of the apparatus.

In a further variation, instead of an apparatus which is a surface of revolution as described above, if geometrical or space constraints demand it, an apparatus which is semicircular or flat can also be profitably employed, and still satisfy the basic principles proposed. The complete apparatus thus corresponds to a fraction of the apparatus described above: the description and diagram given in FIGS. 1 and 2 which represent the cross section of the apparatus remain valid with the exception that the word "funnel" would represent only a half or a quarter of a truncated funnel or even a plane surface if the apparatus were no longer a surface of revolution and in the same way if the deflector were no longer a surface of revolution but semicircular or flat.

In the apparatus of FIG. 1, all the separator stages are aligned along the same axis. This preferred disposition is not obligatory; the axes of the separator stages may be shifted by a limited amount. The majority of the particles must fall within the area of the cone (the section defined by the upper edge of the funnel).

In a further variation, a number of separator means can be located "in parallel" on the same plane in the same container with a supply of particles to be treated for each of the first stage separators.

In a further embodiment, a lone funnel or collector for fines can be located between two separator stages to re-centralise the concentrated stream, or lone deflector(s) can be provided to direct the largest particles towards the edge.

Any combination of these variations is possible.

The advantage of the apparatus of the invention lies in the fact that all the particle streams are re-sorted and in particular, the finest stream of particles from the first separator stage is re-sorted by each of the following stages so that after at least two separator stages, preferably more than two, the concentration of fine or broken particles is significantly reduced. This object is achieved using an apparatus in accordance with the invention which utilises a dynamic bank effect, i.e., that all the particles are always moving to form the bank and to flow, and the bank never blocks (otherwise the catalyst particles would stick together). This effect also means that the container can be completely emptied at any moment without mixing the streams.

In summary, there has been disclosed an apparatus 20 for concentrating fine and broken portions 21 and 22, respectively, of a particle mix 23 which includes whole, substantially spherical particles 24. The apparatus includes a stationary chamber 1 formed about an axis 26 and having a selected diameter D. An inlet 2, smaller than the selected diameter D, and a first outlet 12, smaller than the selected diameter D, allow the particle mix to be introduced through the inlet 2 and exit through the outlet 12.

At least first and second stationary separating stages 32*a* and 32*b* are disposed within the chamber 1 directly below the inlet 2 of the chamber. Each of the separating stages 34*a* and 34*b* include a funnel 3 having an interior wall 36 for funneling a portion of the mix 24 to an outlet 5 aligned with the axis on the chamber 1. The funnels 3 have a stationary upper edge 7 defining an inlet 38 from which depends an outwardly extending deflector 4. The deflector 4 extends downwardly from the edge 7 at an oblique angle with respect to the interior wall of the chamber 1 and terminates in spaced relation to the wall of the chamber to define a gap 40 having a width L. The deflector 4 has perforations 42 therethrough of a size smaller than the whole particles 24, wherein at least a portion of the fine particles 21 and broken particles 22 pass therethrough and fall toward the next separator stage 34*b*, for the extractor funnel 11).

A downwardly extending frustoconical baffle 8 depending from the deflector 4 and defining an outlet opening 46 is aligned with the inlet opening of the adjacent funnel 3 of the next stage (such as the stage 34(*b*)).

The fine and broken particles 21 and 22 which have passed through the perforations 42 fall directly from the baffle 8 of the first stage 34(*a*) into the funnel 3 of the second stage 34(*b*), while the whole particles which have been deflected by the deflector 4 fall through the gap 40 and clear the second stage 34(*b*). Beneath the second stage 34(*b*), there is a stationary extractor 9. The extractor 9 has an extractor funnel 11 with an inlet 50 aligned with the inlet of the baffle 8 directly above the extractor 9. The funnel 11 has a diameter substantially smaller than the diameter D of the chamber to define an annular space therearound through which the particles which have not been separated in the separation stages 34(*a*) and 34(*b*) fall. The second outlet 10, connected to the funnel 11, is isolated from the first outlet 12 for isolating particles which have passed through the separating stages 34(*a*) and 34(*b*) from the particles which have passed over the separating stages, wherein the particles which pass out of the first outlet 12 have a greater concentration of whole particles 24 than the particles passing out of the second outlet 10.

In order to slow down the descent of particles passing through the second stage 34(*b*), the outlet 6 of the second stage funnel 3 has a diameter less than the outlet 5 in the first operating stage 34(*a*).

We claim:

1. An apparatus for concentrating fine or broken particles under gravitational flow, comprising:

at least stationary inlet means for introducing, under gravity, a stream of particles to be treated containing a concentration $C_0$ of fine to broken particles, at least two stationary separating stages arranged as an upper stage and a lower subsequent stage, the lower stage having a width no greater than the upper stage, each stage comprising at least one funnel with an inclined or substantially vertical axis which opens upwardly, located below said introduction means to collect said particles, each stage also comprising at least one deflector connected to said funnel and directed downwardly to allow gravitational flow of the particles and to create a bank of particles at the level of the funnel, wherein some of the particles flow over the stage and some particles flow through the stage, wherein particles flowing over a stage do not pass through the lower subsequent stage;

at least one stationary means for extracting a concentrated particle stream with a concentration $C_1$ of fine to broken particles wherein $C_1>C_0$, said extracting means being located substantially on the axis of the final funnel, and at least one stationary means for recovering at least one stream of particles with a concentration $C_2$ of fine to broken particles wherein $C_2<C_0$.

2. An apparatus according to claim 1, characterised in that the deflector and the funnel have a truncated form.

3. An apparatus according to claim 1, characterised in that the deflector and the funnel have a prismatic form.

4. An apparatus according to claim 1, characterised in that the apparatus comprises at least one funnel without a connected deflector between two consecutive separator stages.

5. An apparatus according to claim 2, characterised in that the apparatus comprises at least one deflector without a connected funnel between two consecutive separator stages.

6. An apparatus according to claim 1, characterised in that the apparatus comprises at least two separator means in parallel.

7. An apparatus according to claim 1, characterised in that the deflector is constituted by a screen and, a frusto-concial solid plate is located beneath the screen to collect and re-centre the fine or broken particles.

8. An apparatus according to claim 1, characterised in that the angle of inclination $\alpha$ of the funnel is greater than the angle of sliding of the particles on the deflector surface by at least 5 degrees.

9. An apparatus according to claim 1, characterised in that the inclination of the deflector to the horizontal is greater than the sliding angle of the particles on the deflector surface by at least 5 degrees.

10. An apparatus according to claim 1, characterised in that the apparatus is for the treatment of reforming catalyst particles with a diameter of between 1.5 and 2.8 mm.

11. An apparatus according to claim 1, characterised in that the apparatus located in a container with a conical, elliptical or hemispherical bottom.

12. An apparatus according to claim 11, characterised in that the stream with concentration $C_1<C_0$ of fine or broken particles is recovered at the bottom of the container containing the apparatus.

13. An apparatus according to claim 1, characterised in that a distance L between the wall of the container containing the apparatus and the extremity of the facing deflector is at least 10 times the diameter of the largest particles.

14. An apparatus for concentrating fine and broken portions of a particle mix, the apparatus comprising:

a stationary chamber formed about an axis and having a selected diameter, an inlet smaller than the selected diameter and a first outlet smaller than the selected diameter, wherein the particle mix is introduced through the inlet;

at least first and second stationary separating stages disposed within the chamber directly below the inlet of the chamber with each separating stage including a funnel having an interior wall for funneling a portion of the mix to an outlet aligned with the axis of the chamber, the funnel having a stationary upper edge defining at inlet from which depends an outwardly extending deflector, the deflector extending downwardly from the edge at an oblique angle with respect to the interior wall and terminating in spaced relation to the wall of the chamber to define a gap therebetween, the deflector having perforations therethrough of a size smaller than the broken particles, wherein at least a portion of the fine particles pass therethrough and fall toward the next separation stage, a downwardly extending frustoconical baffle depending from the deflector and defining an outlet opening substantially aligned with the inlet opening of the adjacent funnel, wherein fine particles which have passed through the perforations fall directly from the baffle of the first stage into the funnel of the second stage, while the broken and fine particles fall through the gap and clear the second stage;

a stationary extractor beneath the separating stages, the extractor having an extractor funnel with an inlet aligned with the outlet of the baffle directly above the extractor, the funnel having a diameter substantially smaller than the diameter of the chamber to define an annular space therearound through which the broken and fine particles which have not been separated in the separation stages fall; and a second outlet isolated from the first outlet and connected to the extractor funnel for isolating particles which have passed through the separating stages from the particles which have passed over the separating stages, wherein the mix of particles which pass out of the first outlet have a greater concentration of broken particles than the mix of particles passing out of the second outlet.

15. The apparatus of claim 14, wherein the funnel of the second separating stage has an outlet of a diameter less than the outlet of the funnel of the first operating stage.

16. The apparatus of claim 15, wherein the funnel of the separating stage positioned directly above the extractor funnel has an outlet of a diameter less than the funnel directly below the inlet of the chamber.

* * * * *